US008783918B2

(12) United States Patent
Mao

(10) Patent No.: US 8,783,918 B2
(45) Date of Patent: Jul. 22, 2014

(54) EASILY MAINTAINABLE LAMP CONNECTION DEVICE

(75) Inventor: Youneng Mao, Guangdong (CN)

(73) Assignees: Dongguan AMC Lighting Co., Ltd., Dongguan Guangdong Province (CN); WAC Lighting Co., Garden City, NY (US)

( * ) Notice: Subject to any disclaimer, the term of this patent is extended or adjusted under 35 U.S.C. 154(b) by 228 days.

(21) Appl. No.: 13/395,644

(22) PCT Filed: Feb. 24, 2011

(86) PCT No.: PCT/CN2011/071218

§ 371 (c)(1), (2), (4) Date: Mar. 12, 2012

(87) PCT Pub. No.: WO2012/113143

PCT Pub. Date: Aug. 30, 2012

(65) Prior Publication Data

US 2012/0218770 A1 Aug. 30, 2012

(51) Int. Cl.

| | |
|---|---|
| ***F21V 17/06*** | (2006.01) |
| ***F21V 17/10*** | (2006.01) |
| ***F21V 1/08*** | (2006.01) |
| ***F21V 21/00*** | (2006.01) |

(52) U.S. Cl.

CPC ..... *F21V 17/107* (2013.01); *F21V 1/08* (2013.01); *F21V 17/06* (2013.01); *F21V 21/00* (2013.01)

USPC ..... 362/433; 362/277; 362/418; 362/457

(58) Field of Classification Search

CPC ..... F21V 1/08; F21V 17/06; F21V 17/10; F21V 17/107; F21V 21/00

USPC ..... 362/277, 418, 433, 457

See application file for complete search history.

(56) References Cited

U.S. PATENT DOCUMENTS 6,578,233 B1 * 6/2003 Avila et al. ..... 16/344

* cited by examiner

*Primary Examiner* — Jason Moon Han

(74) *Attorney, Agent, or Firm* — Global IP Services; Tianhua Gu

(57) ABSTRACT

The present invention relates to an easily-maintainable lamp connection device. The device comprises a lamp body, a front head arranged at an opening end of the lamp body, and a moveable link rod provided between the lamp body and the front head, which is able to slide freely; a stationary ring positioned firmly at the opening end of the lamp body with a gap between said stationary ring and an inside wall of the lamp body; a rod body of the moveable link rod is arranged with going through said gap, after assembling, an upper end of the moveable link rod located inside of the lamp body has a stopper whose size is bigger than that of said gap, and a lower end of the moveable link rod located inside of the front head is hinge jointed with a hinge mechanism inside of the front head.

9 Claims, 3 Drawing Sheets

EASILY MAINTAINABLE LAMP CONNECTION DEVICE

CROSS REFERENCE TO RELATED PATENT APPLICATION

The present application is the US national stage of PCT/CN2011/071218 filed on Feb. 24, 2011, which claims the priority of the PCT/CN2011/071218 filed on Feb. 24, 2011, which application is incorporated herein by reference.

FIELD OF THE INVENTION

The present invention relates to a lamp connection device structure, especially to an easily-maintainable lamp connection device.

BACKGROUND OF THE INVENTION

It is currently needs to disassemble a front head prior to maintain a domestic lamp device structure in general, in this regard, the front head is separated from a lamp body without any connection, and once the lamp structure needs to be maintained, the front head has to be disassembled and placed well before the operations of maintenance inside of the lamp body, then the front head is assembled back to the lamp body after completing the operations, to assemble or maintain the lamp device, in this way, which is in special environments for example, such as high altitude, is of disadvantages of inconvenience and/or insecurity.

SUMMARY OF THE INVENTION

An object of the present invention is to provide an easily-maintainable lamp connection device which can still connect a front head to a lamp body together after disassembling the front head in order to eliminate the defects described above.

The object of the present invention may be achieved by the structure described below: an easily-maintainable lamp connection device comprising a lamp body, a front head arranged at an opening end of the lamp body, and a moveable link rod provided between the lamp body and the front head, which is able to slide freely; a stationary ring positioned firmly at the opening end of the lamp body with a gap between said stationary ring and an inside wall of the lamp body; a rod body of moveable link rod is arranged with going through said gap, after assembling, an upper end of the moveable link rod located inside of the lamp body has a stopper whose size is bigger than that of said gap, and a lower end of the moveable link rod located inside of the front head is hinge jointed with a hinge mechanism inside of the front head.

The front head is lockable arranged at the opening end of said lamp body by using a slot locking structure.

The stationary ring is fixed firmly on a plurality of studs formed inside of said lamp body by using screws.

The hinge mechanism includes an axle and a fixed plate fixed firmly at an inside wall of the front head by using screws, a connecting end of the fixed plate wraps around the axle and forms a hinge structure; said lower end of the moveable link rod wraps around the axle and forms a hinge structure.

Said axle has its both ends fixed at an inside of an assembling recess located in a wall of the front head.

The lamp connection device makes it possible with the structure described herein to keep the connection between the front head and the lamp body by using the moveable link rod to held them together while a bulb needs to be changed and/or the device needs to be maintained and the front head is disassembled, which may make sure security and convenience for operations, especially for one hand operation in special environments for example, such as high altitude etc.

DETAILED DESCRIPTION OF THE INVENTION

Figure 1:
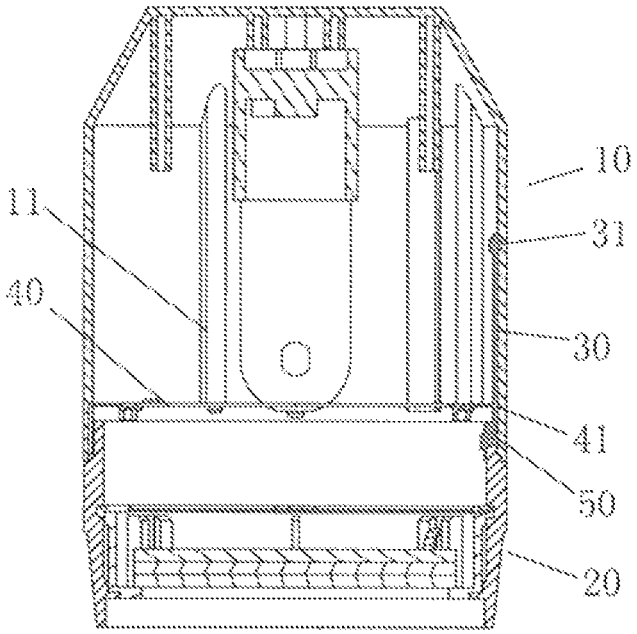
FIG. 1 is a cross-sectional, schematic view of a lamp connection device according to the present invention.
Figure 2:
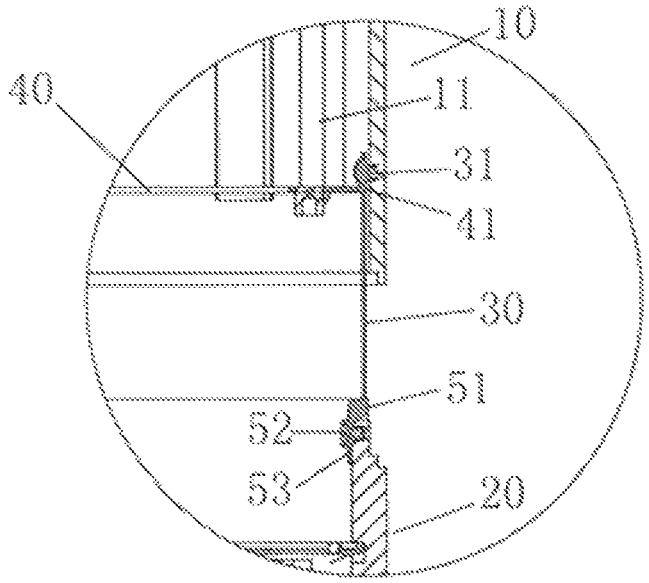
FIG. 2 is a partial, cross-sectional view of the connection device according to the present invention.
Figure 3:
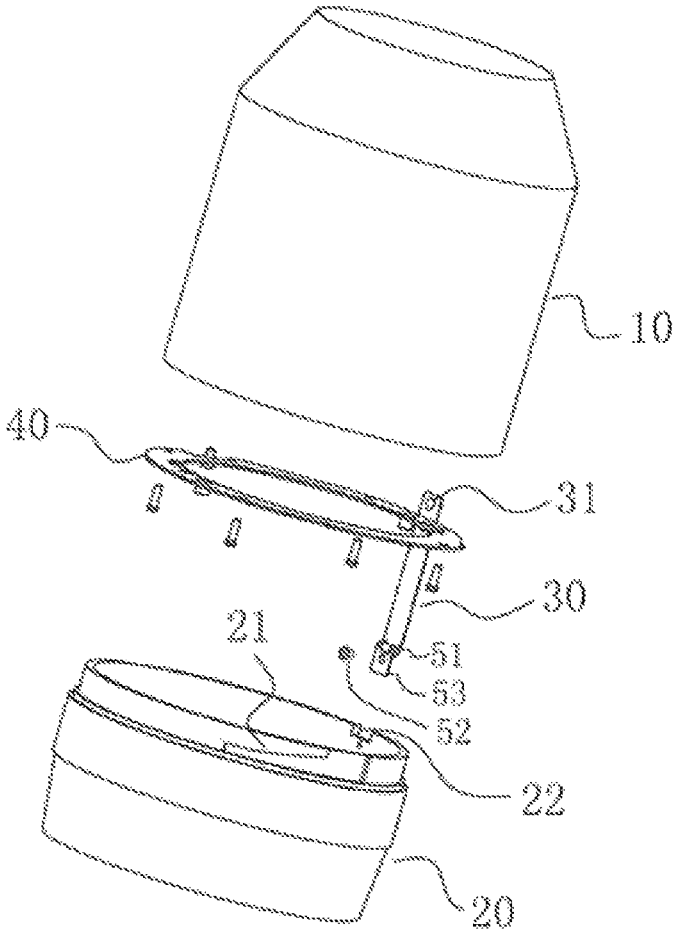
FIG. 3 is an exploded, perspective view of the lamp connection device according to the present invention.
Figure 4:
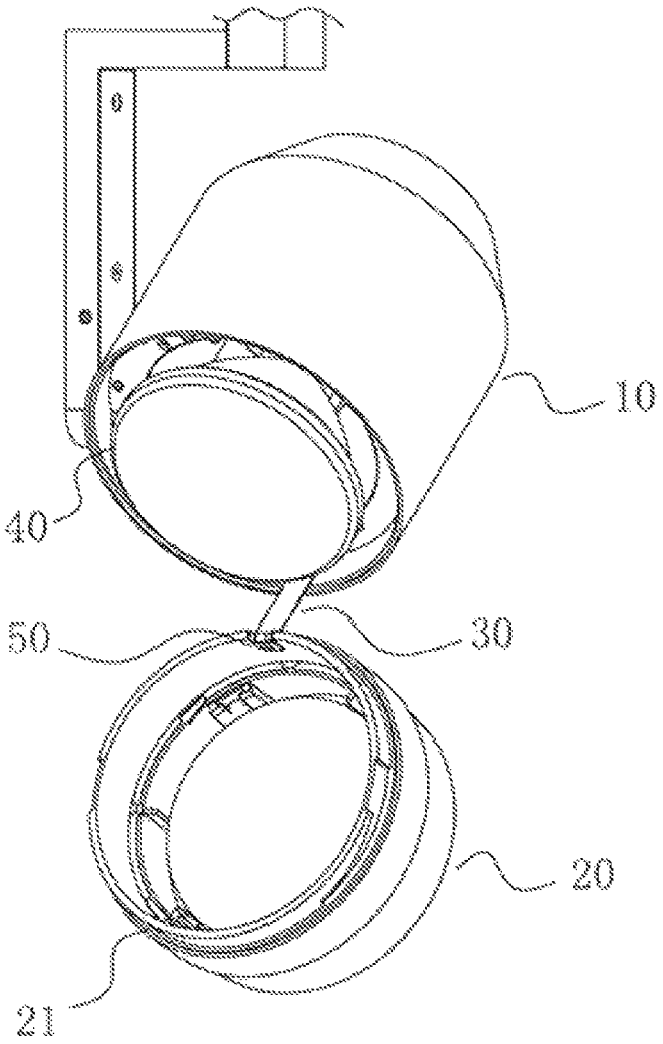
FIG. 4 is a perspective view of the lamp connection device in using state according to the present invention.

As shown in FIGS. 1-4, the present invention provides an easily-maintainable lamp connection device comprising a lamp body 10, a front head 20 arranged at an opening end of the lamp body 10, and a moveable link rod 30 provided between the lamp body 10 and the front head 20, which is able to slide freely; a stationary ring 40 positioned firmly at the opening end of the lamp body 10 with a gap 41 between said stationary ring 40 and an inside wall of the lamp body 10; a rod body of the moveable link rod 30 is arranged with going through said gap 41, after assembling, an upper end of the moveable link rod 30 located inside of the lamp body has a stopper 31 whose size is bigger than that of said gap 41, and a lower end of the moveable link rod 30 located inside of the front head is hinge jointed with a hinge mechanism 50 inside of the front head 20.

Said front head 20 is lockable arranged at the opening end of said lamp body 10 by using a slot locking structure 21.

Said stationary ring 40 is fixed firmly on a plurality of studs 11 formed inside of said lamp body 10 by using screws 52.

Said hinge mechanism 50 includes an axle 51 and a fixed plate 53 fixed firmly at an inside wall of the front head 20 by using screws 52, a connecting end of the fixed plate 53 wraps around the axle 51 and forms a hinge structure; said lower end of the moveable link rod 30 wraps around the axle 51 and forms a hinge structure.

Said axle 51 has its both ends fixed at an inside of a assembling recess 22 located in a wall of the front head 20.

Once the lamp device needs maintenance and/or changing bulb, disassembling the front head 20 and pulling out for a distance away from the lamp body may drive the moveable link rod 30 to slide, but which can not slide off because of being blocked by the stationary ring 40 that the stopper 31 of the moveable link rod 30 is stopped in the gap 41 between the stationary ring 40 and the lamp body 10, in this way, the front head 20 may be separated from the lamp body 10 without losing connection which is helpful for the operations of maintenance conveniently regardless of worrying about the front head 20 falling off, which is suitable for the operations in special environments for example, such as high altitude; the maintenance is completed by pushing the front head 20 back into the lamp body 10 with the moveable link rod 30 being put back the inside of the lamp body 10 and locking the front head after the operations.

It will be appreciated that what described above are only for the preferable example embodiments according to the present invention, thus, it is intended that the present invention covers the modifications and variations of this invention provided they come within the scope of the appended claims and their equivalents.

What is claimed is:

1. An easily-maintainable lamp connection device comprises a lamp body, a front head arranged at an opening end of the lamp body, and a moveable link rod provided between the lamp body and the front head, which is able to slide freely; a stationary ring positioned firmly at the opening end of the lamp body with a gap between said stationary ring and an inside wall of the lamp body; a rod body of the moveable link rod is arranged with going through said gap, after assembling, an upper end of the moveable link rod located inside of the lamp body has a stopper whose size is bigger than that of said gap, and a lower end of the moveable link rod located inside of the front head is hinge jointed with a hinge mechanism inside of the front head.

2. The easily-maintainable lamp connection device of claim 1, characterized in that said front head is lockable arranged at the opening end of said lamp body by using a slot locking structure.

3. The easily-maintainable lamp connection device of claim 1, characterized in that said stationary ring is fixed firmly on a plurality of studs formed inside of said lamp body by using screws.

4. The easily-maintainable lamp connection device of claim 1, characterized in that said hinge mechanism includes an axle and a fixed plate fixed firmly at an inside wall of the front head by using screws, a connecting end of the fixed plate wraps around the axle and forms a hinge structure; said lower end of the moveable link rod wraps around the axle and forms a hinge structure.

5. The easily-maintainable lamp connection device of claim 4, characterized in that both ends of said axle are fixed at an inside of an assembling recess located in a wall of the front head.

6. The easily-maintainable lamp connection device of claim 2, characterized in that said hinge mechanism includes an axle and a fixed plate fixed firmly at an inside wall of the front head by using screws, a connecting end of the fixed plate wraps around the axle and forms a hinge structure; said lower end of the moveable link rod wraps around the axle and forms a hinge structure.

7. The easily-maintainable lamp connection device of claim 3, characterized in that said hinge mechanism includes an axle and a fixed plate fixed firmly at an inside wall of the front head by using screws, a connecting end of the fixed plate wraps around the axle and forms a hinge structure; said lower end of the moveable link rod wraps around the axle and forms a hinge structure.

8. The easily-maintainable lamp connection device of claim 6, characterized in that both ends of said axle are fixed at an inside of an assembling recess located in a wall of the front head.

9. The easily-maintainable lamp connection device of claim 7, characterized in that both ends of said axle are fixed at an inside of an assembling recess located in a wall of the front head.

* * * * *